US009156061B2

(12) United States Patent
Robertson

(10) Patent No.: US 9,156,061 B2
(45) Date of Patent: Oct. 13, 2015

(54) INJECTION MOLDED GRID FOR SAVING SCREEN FRAMES

(71) Applicant: United Wire Limited, Edinburgh (GB)

(72) Inventor: Graham Robertson, Edinburgh (GB)

(73) Assignee: United Wire Limited, Edinburgh (GB)

( * ) Notice: Subject to any disclaimer, the term of this patent is extended or adjusted under 35 U.S.C. 154(b) by 257 days.

(21) Appl. No.: 13/792,791

(22) Filed: Mar. 11, 2013

(65) Prior Publication Data

US 2013/0199012 A1 Aug. 8, 2013

Related U.S. Application Data

(62) Division of application No. 11/859,223, filed on Sep. 21, 2007, now Pat. No. 8,393,474.

(60) Provisional application No. 60/827,601, filed on Sep. 29, 2006.

(51) Int. Cl.
*B07B 1/46* (2006.01)
*E21B 21/06* (2006.01)

(52) U.S. Cl.
CPC ..... *B07B 1/4627* (2013.01); *B07B 1/4618* (2013.01); *B07B 1/4663* (2013.01); *E21B 21/065* (2013.01); *Y10T 29/4973* (2015.01);
(Continued)

(58) Field of Classification Search
CPC .. B07B 1/4627; B07B 1/4663; B07B 1/4618; E21B 21/065; Y10T 29/49947; Y10T 29/49815; Y10T 29/49746; Y10T 29/49721; Y10T 29/4973; Y10T 29/49826
USPC ..... 29/402.07, 402.06, 402.04, 402.01, 29/402.08, 402.11, 402.12, 402.14, 29/402.15, 402.19, 428, 426.1, 502.01; 264/328; 209/403, 399, 405, 397, 400, 209/401
See application file for complete search history.

(56) References Cited

U.S. PATENT DOCUMENTS 5,049,262 A 9/1991 Galton et al.
5,816,413 A 10/1998 Boccabella et al.
(Continued)

FOREIGN PATENT DOCUMENTS

CA 2528542 A1 6/2007
DE 20307614 7/2009
(Continued)

OTHER PUBLICATIONS

International Search Report with Written Opinion issued in PCT Applicationo No. GB20071003693 dated Aug. 4, 2009. (15 pages).
(Continued)

*Primary Examiner* — John C Hong
(74) *Attorney, Agent, or Firm* — Osha Liang LLP

(57) ABSTRACT

A shaker screen including a composite frame, a removable grid attached to the composite frame, and at least one filtering element attached to the removable grid is disclosed. A method including forming a composite frame, forming a removable grid, attaching at least one filtering element to the removable grid, and attaching the removable grid to the composite frame is disclosed. Additionally, a method for rebuilding a shaker screen, the method including removing a first screen assembly from a composite frame, the screen assembly having a removable grid and at least one filtering element, and attaching a second screen assembly to the composite frame is disclosed.

16 Claims, 4 Drawing Sheets

(52) U.S. Cl.
CPC ..... *Y10T 29/49721* (2015.01); *Y10T 29/49746* (2015.01); *Y10T 29/49815* (2015.01); *Y10T 29/49826* (2015.01); *Y10T 29/49947* (2015.01)

(56) References Cited

U.S. PATENT DOCUMENTS

| | | | |
|---|---|---|---|
| 5,967,336 | A | 10/1999 | Baltzer et al. |
| 6,241,098 | B1 | 6/2001 | Schulte et al. |
| 6,662,952 | B2 | 12/2003 | Adams et al. |
| 7,063,214 | B2 | 6/2006 | Schulte, Jr. et al. |
| 2004/0074821 | A1 | 4/2004 | Russell et al. |

FOREIGN PATENT DOCUMENTS

| | | | |
|---|---|---|---|
| EP | 1205265 | A2 | 5/2002 |
| FR | 1053728 | A | 2/1954 |

OTHER PUBLICATIONS

Examination Report issued in related Canadian Patent Application No. 2,664,459; Dated Jul. 7, 2010 (2 pages).
Examiner's Report issued in corresponding Canadian Application No. 2,664,459; Dated Apr. 26, 2011 (2 pages).
Official Action issued in corresponding Mexican Application No. MX/a/2009/003267; Dated Nov. 3, 2011 (7 pages).
Office Action issued in corresponding Chinese Application No. 200780036079.1; Dated May 3, 2012 (7 pages).
Office Action issued in corresponding Mexican Application No. MX/a/2009/003267 with English language correspondence reporting the same; Dated May 7, 2012 (10 pages).
Office Action issued in corresponding Mexican Application No. MX/a/2009/003267 with English language correspondence reporting the same; Dated Oct. 5, 2012 (8 pages).
Office Action issued in corresponding Chinese Application No. 200780036079.1; Dated Aug. 7, 2013 (9 pages).
Office Action issued in corresponding Chinese Application No. 200780036079.1; Dated Feb. 26, 2013 (11 pages).
Office Action issued in corresponding Chinese Application No. 200780036079.1 dated Jan. 23, 2014 (7 pages).
Office Action in counterpart European Patent Application No. 07823954.8, mailed Aug. 5, 2014 (5 pages).
Examination Report issued in corresponding Indian Application No. 2045/DELNP/2009; Dated Oct. 24, 2014 (2 pages).
Office Action in European Application No. 07823954.8; Dated Mar. 24, 2015 (5 pages).

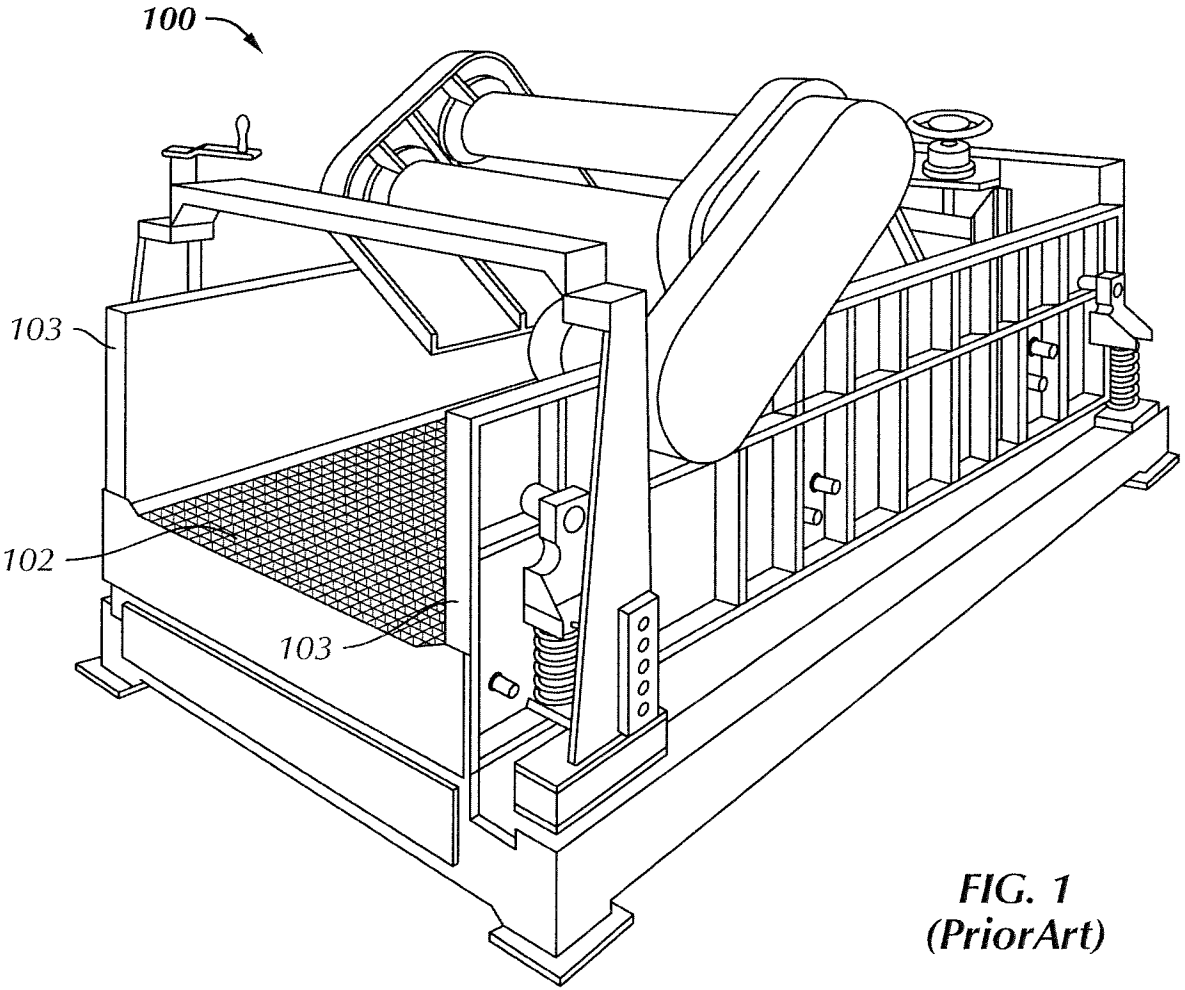
FIG. 1
(PriorArt)

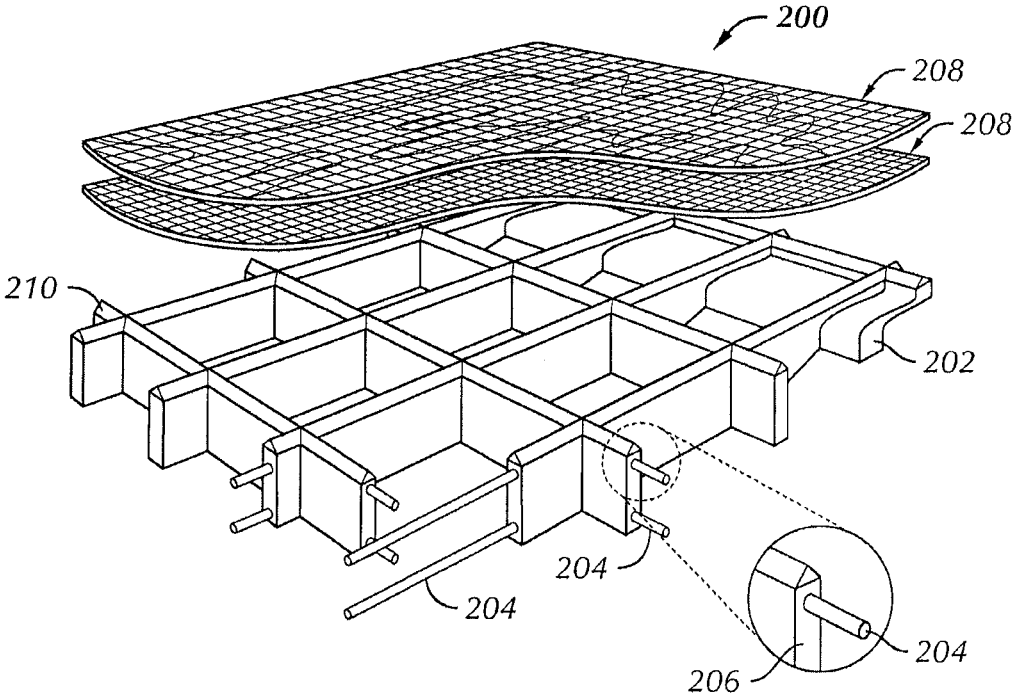
FIG. 2
(PriorArt)

INJECTION MOLDED GRID FOR SAVING SCREEN FRAMES

CROSS REFERENCE TO RELATED APPLICATIONS

This application is a divisional application and claims benefit under 35 U.S.C. §120 to U.S. patent application Ser. No. 11/859,223, filed Sep. 21, 2007, issued as U.S. Pat. No. 8,393,474, on Mar. 12, 2013, which claims priority, pursuant to 35 U.S.C. §119(e), to U.S. Provisional Patent Application Ser. No. 60/827,601, filed on Sep. 29, 2006. All of these applications are incorporated by reference in their entirety.

BACKGROUND

1. Field of the Disclosure

Embodiments disclosed herein relate generally to oilfield shakers. More particularly, embodiments disclosed herein relate to pre-tensioned screens for oilfield shakers.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling mud are commonly referred to in the industry as "shale shakers." A shale shaker, also known as a vibratory separator, is a vibrating sieve-like table upon which returning dirty drilling mud is deposited and through which clean drilling mud emerges. Typically, the shale shaker is an angled table with a generally perforated filter screen bottom. Returning drilling mud is deposited at the top of the shale shaker As the drilling mud travels down the incline toward the lower end, the fluid falls through the perforations to a reservoir below leaving the solid particulate material behind The combination of the angle of inclination with the vibrating action of the shale shaker table enables the solid particles left behind to flow until they fall off the lower end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling mud flow rates and particulate percentages in the drilling mud. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

Because shale shakers are typically in continuous use, any repair operations and associated downtimes are to be minimized as much as possible. Often, the filter screens of shale shakers, through which the solids are separated from the drilling mud, wear out over time and need replacement. Therefore, shale shaker filter screens are typically constructed to be quickly and easily removed and replaced. Generally, through the loosening of only a few bolts, the filter screen can be lifted out of the shaker assembly and replaced within a matter of minutes. While there are numerous styles and sizes of filter screens, they generally follow similar design. Typically, filter screens include a perforated plate base upon which a wire mesh, or other perforated filter overlay, is positioned. The perforated plate base generally provides structural support and allows the passage of fluids therethrough, while the wire mesh overlay defines the largest solid particle capable of passing therethrough. While many perforated plate bases are generally flat or slightly curved in shape, it should be understood that perforated plate bases having a plurality of corrugated or pyramid-shaped channels extending thereacross may be used instead. In theory, the pyramid-shaped channels provide additional surface area for the fluid-solid separation process to take place, and act to guide solids along their length toward the end of the shale shaker from where they are disposed.

A typical shale shaker filter screen includes a plurality of hold-down apertures at opposite ends of the filter screen. These apertures, preferably located at the ends of the filter screen that will abut walls of the shale shaker, allow hold down retainers of the shale shaker to grip and secure the filter screens in place. However, because of their proximity to the working surface of the filter screen, the hold-down apertures must be covered to prevent solids in the returning drilling fluid from bypassing the filter mesh through the hold-down apertures. To prevent such bypass, an end cap assembly is placed over each end of the filter screen to cover the hold-down apertures. Presently, these caps are constructed by extending a metal cover over the hold down apertures and attaching a wiper seal thereto to contact an adjacent wall of the shale shaker. Furthermore, epoxy plugs are set in each end of the end cap to prevent fluids from communicating with the hold-down apertures through the sides of the end cap.

Typically, screens used with shale shakers are emplaced in a generally horizontal fashion on a generally horizontal bed or support within a basket in the shaker. The screens themselves may be flat or nearly flat, corrugated, depressed, or contain raised surfaces. The basket in which the screens are mounted may be inclined towards a discharge end of the shale shaker. The shale shaker imparts a rapidly reciprocating motion to the basket and hence the screens. Material from which particles are to be separated is poured onto a back end of the vibrating screen. The material generally flows toward the discharge end of the basket. Large particles that are unable to move through the screen remain on top of the screen and move toward the discharge end of the basket where they are collected. The smaller particles and fluid flow through the screen and collect in a bed, receptacle, or pan beneath the screen.

In some shale shakers a fine screen cloth is used with the vibrating screen. The screen may have two or more overlying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism (e.g., an unbalanced weight on a rotating shaft connected to the frame). Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

A typical shaker is shown in FIG. 1. In typical shakers, a screen 102 is detachably secured to the vibrating shaker machine 100. With the screen or multiple screens secured in place, a tray is formed with the opposed, parallel sidewalls 103 of shaker 100. The drilling mud, along with drill cuttings and debris, is deposited on top of screen 102 at one side. Screen 102 is vibrated at a high frequency or oscillation by a motor or motors for the purpose of screening or separating materials placed on screen 102. The liquid and fine particles will pass through screen 102 by force of gravity and be recovered underneath. Solid particles above a certain size migrate and vibrate across screen 102 or screens where they are removed. Filtering elements attached to screen 102 may further define the largest solid particle capable of passing therethrough.

While there are numerous styles and sizes of shaker screens, shaker screens can generally be categorized as either a hook strip type or a pre-tensioned (rigid frame) type. Both types contain one or more layers of filtering element. A distinction between the two types is that the filtering element layers of a hook strip type are not fully tensioned until they are attached to the shaker while the filtering element layers of a pre-tensioned type are in tension before the screen is attached to the shaker.

Pre-tensioned screens usually include one or more filtering element layers that are attached to a supporting frame. The filtering element layers are stretched across and then secured to the supporting frame. Typically, the frame is rigid and provides structural support for the filtering element layers while allowing the passage of fluids. The frame of a pre-tensioned screen may include crossmembers and/or transverse ribs and may be formed from any material known in the art. Among the materials commonly used to form frames are stainless steels and other metal alloys. Composite frames consisting of two or more materials are also common.

FIG. 2 is an exploded cutaway view of a typical prior art pre-tensioned composite screen 200. Composite frame 202 includes steel rods 204 forming a frame sub-structure surrounded by a plastic outer frame 206. Two filtering element layers 208 are attached to the top side 210 of composite frame 202.

Often, the first component of a composite shaker screen to wear out or otherwise become unusable is one or more of the filtering element layers attached to the supporting frame. Composite frames still in good condition are often discarded because a filtering element layer attached to the frame is worn. This practice wastes the resources that form the composite frame and is cost inhibitive.

Accordingly, there is a recognized need for shaker screen designs having a composite frame where the composite frame may be reused after one or more of the filtering element layers attached to the composite frame need to be replaced.

SUMMARY OF THE DISCLOSURE

In one aspect, embodiments disclosed herein relate a shaker screen including a composite frame, a removable grid attached to the composite frame, and at least one filtering element attached to the removable grid.

In another aspect, embodiments disclosed herein relate to a method of manufacturing a shaker screen, the method including forming a composite frame, forming a removable grid, attaching at least one filtering element to the removable grid, and attaching the removable grid to the composite frame.

In another aspect, embodiments disclosed herein relate to a method for rebuilding a shaker screen, the method including removing a first screen assembly from a composite frame, the screen assembly having a removable grid and at least one filtering element, and attaching a second screen assembly to the composite frame.

Other aspects of the present disclosure will be apparent from the following description and the appended claims.

BRIEF DESCRIPTION OF DRAWINGS

FIG. 1 is an illustration of a conventional shaker.

FIG. 2 is a prospective cutaway view of a portion of a prior art composite screen.

DETAILED DESCRIPTION

In one aspect, embodiments disclosed herein relate to pre-tensioned composite screens for an oilfield shaker. More specifically, embodiments disclosure herein relate to pre-tensioned composite screens including removable screen assemblies. More specifically still, embodiments disclosed herein relate to pre-tensioned composite shaker screens and methods of manufacturing and rebuilding such screens.

Generally, embodiments disclosed herein include a composite frame, at least one removable grid attached to the composite frame, and at least one filtering element attached to the at least one removable grid. In at least one embodiment, such screens provide a shaker operator the ability to remove the grid from the composite frame and attach a new grid to the original composite frame.

Figure 3:
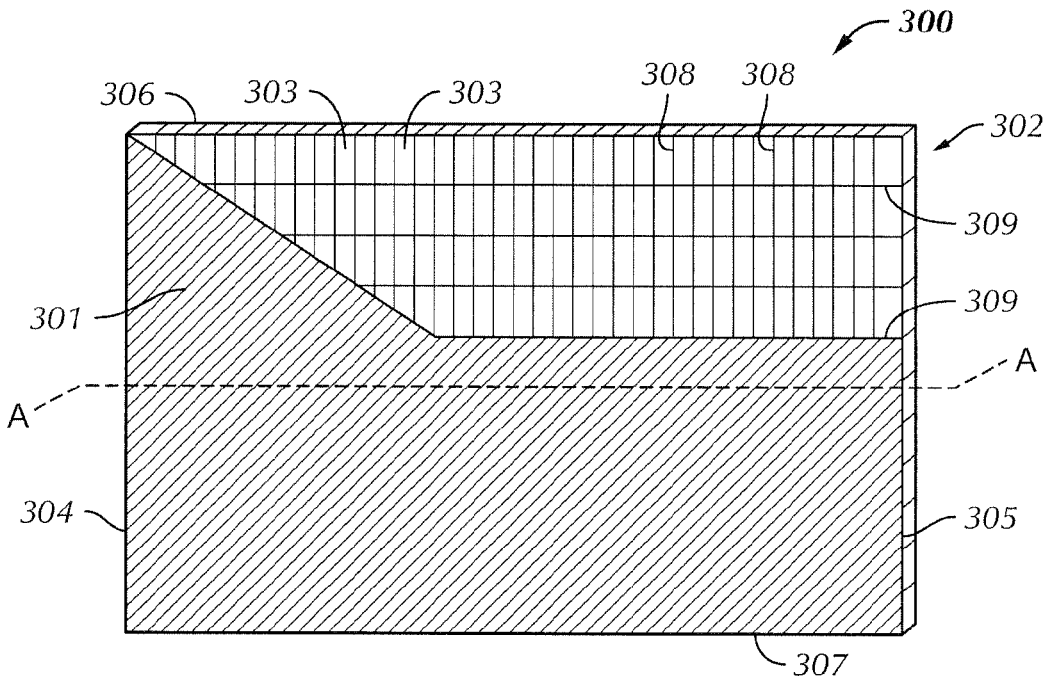
FIG. 3 is a top view of a screen in accordance with one embodiment of the present disclosure.

Referring to FIG. 3, a top view of a screen 300 for a shaker in accordance with one embodiment of the present disclosure is shown. In this embodiment, screen 300 is illustrated including a partially removed filtering element 301 attached to a removable grid 302. Filtering element 301 covers a plurality of apertures 303 in grid 302 such that solid particles larger than perforations in filtering element 301 will not pass through screen 300. Removable grid 302 includes a first side 304 and a second side 305 extending between a first end 306 and a second end 307. In this embodiment, first side 304 and second side 305 side are substantially parallel, and first end 306 and second end 307 are also substantially parallel. A plurality of longitudinal cross-members 308 extend between first end 306 and second end 307, while a plurality of transverse ribs 309 are arrayed between the first side 306 and second side 307. Thus, apertures 303 are formed from the intersection of transverse ribs 309 and cross-members 308.

While the embodiment shown in FIG. 3 illustrates apertures 303 of substantially equal configuration (i.e., of same size and shape), one of ordinary skill in the art will appreciate that alternate size and shape perforations 303 may be formed by varying the number of cross-members 308 and the angles of intersection between such cross-members 308 and transverse ribs 309. Correspondingly, alternate embodiments may include apertures 303 which may be substantially asymmetrical, square, circular, triangular, or any other shape known to one of ordinary skill in the art. Furthermore, the relative size of apertures 303 may be varied to change the rate of drilling fluid and particulate flow therethrough.

Figure 4:
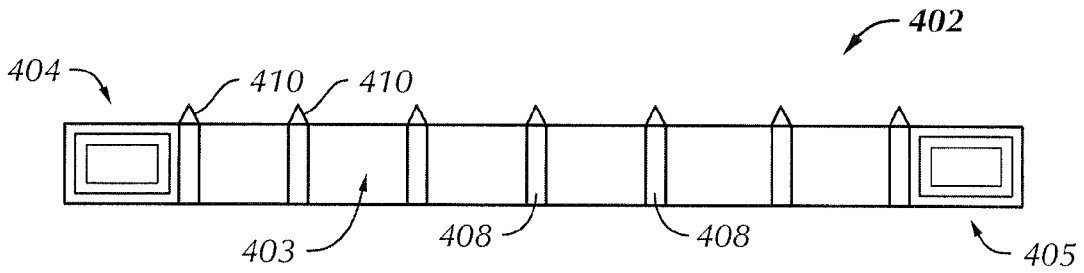
FIG. 4 is a cross-section view of a composite frame in accordance with one embodiment of the present disclosure.

Referring to FIG. 4, a cross-sectional side view of a composite frame 402, taken through line A-A of the screen of FIG. 3, is shown in accordance with one embodiment of the present disclosure. Composite frame 402 includes a first side 404, a second side 405, and a plurality of cross-members 408. Cross-members 408 intersect a plurality of transverse ribs (not shown) thereby creating a plurality of apertures 403 as described above. In this embodiment, cross-members 408 include a plurality of contact points 410 for supporting and/or attaching a removable grid (not shown). As illustrated, contact points 410 may be of generally pyramidal shape and protrude from cross-members 408 and/or transverse ribs (not shown). Contact points 410 may extend from the top of cross-members 408 and/or transverse ribs (not shown) such that a filtering element (not shown) may be attached thereto. To attach the filtering element (not shown) to composite frame 402, the filtering elements may be stretched taut over contact points 410 and then heat and pressure may be applied to contact points 410 to melt and seep through the filtering element. Once contact points 410 melt through the filtering element (not shown), contact points 410 may no longer protrude through the filtering element. Thus, by melting and flattening contact points (410), the filtering element (not shown) and/or filtering elements may be attached so as to hold the screen assembly in tension.

Composite frame 402 may be formed from any material and by any method known in the art. In one embodiment, composite frame 402 may be formed from a frame sub-structure including high-strength steel beams, having a hollow cross-section, and high strength steel rods. The frame sub-structure may be enclosed in a high-strength, glass reinforced plastic outer frame, wherein the frame sub-substructure forms part of both cross-members 408 and/or transverse ribs (not shown). The composite material may include high-strength plastic, mixtures of high-strength plastic and glass, high-strength plastic reinforced with high-tensile-strength steel rods, and any combination thereof. One of ordinary skill in the art will appreciate that the frame sub-structure and the outer frame may be formed in any configuration and from any material or combination or materials known in the art. Alternatively, composite frame 402 may be formed through injection molding, gas-assisted injection molding, extrusion, and/or any other process known in the art.

Figure 5:
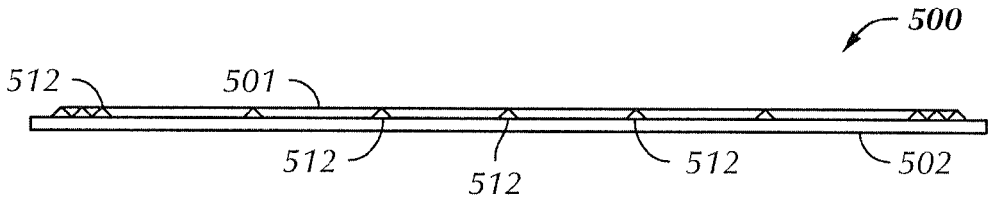
FIG. 5 is a side view of a screen assembly in accordance with one embodiment of the present disclosure.

Referring now to FIG. 5, a side view of a screen assembly 500 in accordance with one embodiment of the present disclosure is shown. Generally, a screen assembly 500 includes a removable grid 502 and a filtering element 501. In this embodiment, removable grid 502 is illustrated including a plurality of filtering element attachment points 512 extending from ends of removable grid 502 for attaching and pre-tensioning filtering element 501 to removable grid 502. As illustrated, filtering element attachment points 512 may terminate at a substantially similar height, thereby forming a surface of consistent height for attaching filtering element 501. In alternate embodiments, filtering element attachment points 512 may extend to different heights, or in certain instances, may not extend out of removable grid 502. In such non-extending embodiments, filtering element attachment points 512 may be recessed into removable grid 502, and filtering element 501 may be attach thereto.

Removable grid 502 may be formed by, among other processes, injection molding, gas injection molding, and/or extrusion. In embodiments using injection molding, a molten material is injected at a high pressure into a mold having an inverse shape of a desired grid. The configuration of the grid may be, for example, any configuration described above, and/or shown in FIGS. 1-6. The mold may be formed by a toolmaker or mold maker from metals (e.g., steel or aluminum) and precision-machined to form smaller, more detailed features. Once the mold is filled with molten material, the molten material is allowed to cure and is then removed from the mold. The grid may be filled with any molten material known to one of ordinary skill in the art.

Alternatively, a removable grid 502 in accordance with embodiments described herein may be formed by gas-assist injection molding. In this embodiment, molten material is injected into a mold, partially filling it with a predetermined amount of resin or molten material. A gas (e.g., nitrogen) is introduced into the mold cavity. The gas forms hollow channels as it follows a path of least resistance, thereby directing the molten material to fill all areas of the mold. As the gas expands in the cavity, forcing the molten material outward, all of the surfaces receive substantially equal pressure. Subsequently, the molten material is allowed to cure, the gas may be vented through a nozzle or vent, and the grid may be removed from the mold. In other embodiments, removable grid 502 may be formed by any of the processes of forming a frame discussed above such as, for example, sub-structure framing.

Filtering element 501 may include, for example, a mesh, a fine screen cloth, combinations thereof, and/or any other materials known to one of ordinary skill in the art. Furthermore, filtering elements 501 may be formed from, for example, plastics, metals, alloys, fiberglass, composites and/or polytetrafluorethylene. In certain embodiments, multiple layers of filtering elements 501 may be used, and in such multiple layer filtering elements 501, filtering elements 501 with different size perforations may be used. In such embodiments, the filtering element layers should preferably be arranged wherein coarser filtering elements are disposed closer to removable grid 502, while finer layers are disposed on top of the coarser layers.

While attaching filtering element 501 to removable grid 502, in accordance with any of the methods described above, filtering element 501 may be pre-tensioned. In one embodiment, filtering element 501 may be stretched over attachment points 512 so that filtering element 501 is tensioned to a pre-selected level. Filtering element 512 may then be attached to removable grid 502 by, for example, heat staking, ultrasonic welding, mechanical fastening, chemical adhesion, and/or thermal bonding. Alternatively, one of ordinary skill in the art will appreciate that filtering element 501 may be attaching to removable grid 502 in accordance with any method known in the art.

Removable grid 502 may also be coated with polymer, epoxies, of combinations thereof to further enhance the anti-corrosion properties of the grid. In certain embodiments, removable grid 502 may be coated in materials such as, powder epoxies and/or polymers, such as polyethylene and/or polypropylene. Those of ordinary skill in the art will appreciate that additional polymers and epoxies not specifically disclosed may also be used to coat removable grid 502.

Figure 6:
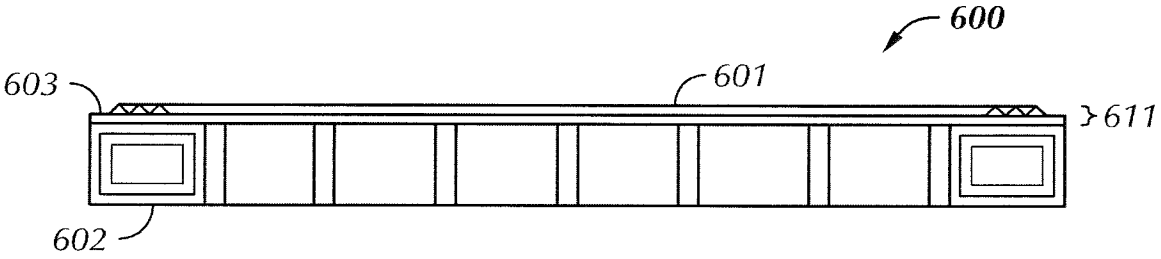
FIG. 6 is a cross-section view of a shaker screen in accordance with one embodiment of the present disclosure.

Referring to FIG. 6, a cross-sectional side view of a shaker screen 600 taken through line A-A of FIG. 3 is shown in accordance with one embodiment of the present disclosure. Shaker screen 600 includes a composite frame 602 and a screen assembly 611. Screen assembly 611 includes a filtering element 601 and a removable grid 603. In this embodiment, removable grid 603 is attached to composite frame 602 such that when filtering element 601 and/or removable grid 603 becomes worn from use, removable grid 603 may be removed from composite frame 602.

Figure 8:
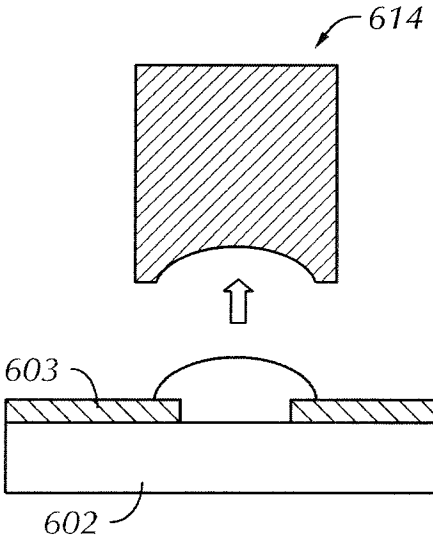
FIGS. 7-8 are cross-section views of heat staking a removable grid to a composite frame in accordance with an embodiment of the present disclosure.
Figure 7:
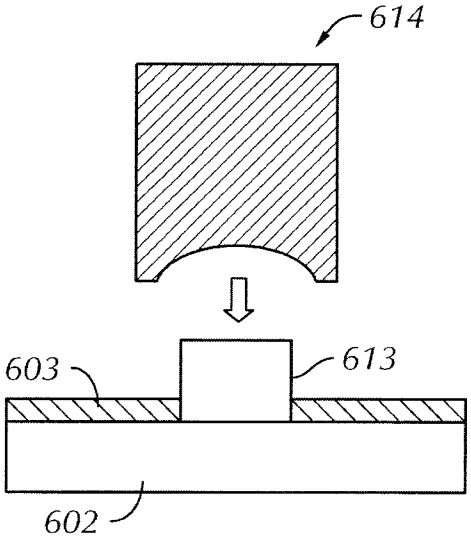

Removable grid 603 may be attached to composite frame 602 according to any attachment method known to one of ordinary skill in the art including, but not limited to, bonding, mechanical fastening, and chemical adhesion. In one embodiment, removable grid 603 may be attached to composite frame 602 using heat staking. Referring briefly to FIGS. 7 and 8 together, a cross-sectional view of a method of heat staking removable grid 603 to composite frame 602, in accordance with an embodiment of the present disclosure, is shown. Heat staking, also referred to as thermal staking, heading, or riveting, is the controlled flow of molten material to attach two components together. When heat staking removable grid 603 to composite frame 602, a hole in removable grid 603, for receiving a premolded contact point 613 extending from composite frame 602, may be formed. A heated tip 614 then contacts premolded contact point 613 and creates localized heat. The heat melts premolded contact point 613 so that the contact point melts over removable grid 603 in a form according to the shape of the heated tip. The melted plastic is then allowed to cool, and when the plastic solidifies, removable grid 603 is attached to composite frame 602.

In alternate methods of heat staking, the contact point may be externally affixed to composite frame 602, rather than being integral to composite frame 602. In embodiments where external attachment points are affixed to composite frame 602, external attachment points may be formed from any material known to one of ordinary skill in the art, including, acrylonitrile butadiene styrene, modified phenylene oxide, and polypropylene. Generally, other appropriate heat staking materials may include thermoplastics, crystalline polymers, and amorphous polymers.

In another embodiment, removable grid 603 may be attached to composite frame 602 using ultrasonic welding. Ultrasonic welding is the conversion of high-frequency electrical energy to high-frequency mechanical energy. The mechanical energy is applied to a plastic material as a vertical vibrating motion under pressure, and heat is generated at the contact point of two materials (e.g., composite frame 602 and removable grid 603) such that the two materials become attached. Contact points for attaching composite frame 602 to removable grid 603 may include portions of composite frame 603 which are integral, or external attachment points attached to composite frame 603 either before or after manufacture.

One of ordinary skill in the art will appreciate that any method of bonding composites to metal and/or composites to composites may be used so as to attach removable grid 603 to composite frame 602. In methods of ultrasonic welding wherein external attachment points are affixed to composite frame 602, external attachment points may be formed from any material known to one of ordinary skill in the art, including, styrene-maleic-anhydride, polycarbonates, acrylonitrile butadiene styrene, and combinations thereof. Generally, other appropriate ultrasonic welding materials may include thermoplastics, crystalline polymers, and amorphous polymers.

In still another embodiment, removable grid 603 may be attached to composite frame 602 using mechanical fastening. Mechanical fasteners may include bolts, rivets, screws, and any other fastening device capable of attaching removable grid 603 to composite frame 602. One mechanical method of attaching removable grid 603 to composite frame 602 may include fasteners attached to removable grid 603 that are configured to engage a fastening structure of composite frame 602. While not independently illustrated, one of ordinary skill in the art will appreciate that any method of mechanically fastening a metal to a composite and/or a composite to another composite may be used so as to attach removable grid 603 to composite frame 602. Preferably, the mechanical fasteners will include corrosion resistant and or coated material, such as plastics and/or composites, to reduce failure of the fasteners. Certain embodiments may include a combination of mechanical fasteners and, for example, heat staking, to attach removable grid 603 to composite frame 602.

Possible methods of detaching removable grid 603 from composite frame 602 may include a mechanical stripping process or removal of the fasteners connecting the two parts. Methods used to detach removable grid 602 from composite frame 603 may vary depending on the method by which removable grid 602 was attached to composite frame 602. When threaded fasteners were used, removable grid 603 and composite frame 602 may be separated by unscrewing the threaded fasteners. Alternatively, if non-threaded fasteners are used, a different method of removal, such as by severing the fasteners, may be appropriate. When removable grid 603 is attached to composite frame 602 by heat staking, they may be separated by severing the stakes, by heating the stakes until they are soft enough that removable grid 603 and composite frame 602 may be separated, or by another method known to one of ordinary skill in the art. Alternative embodiments may use any other methods known to those of ordinary skill in the art, such as for example, chemical stripping, to separate removable grid 603 from composite frame 602.

Certain embodiments in accordance with the present disclosure may have filtering elements that are attached to the removable grid before the removable grid is attached to the composite frame. In these embodiments, the tension in the filtering elements, resulting from their attachment to the removable grid, may prevent the grid and filtering element assembly from lying substantially flat, that is, the grid may be bowed. The attachment of the removable grid to the composite frame may force the grid to conform to the overall shape of the composite frame. Such screen assemblies may be substantially flat after the grid is attached to the composite frame. Other embodiments may include removable grids that are rigid enough to remain substantially flat, even when filtering elements are attached to the removable grid before the removable grid is attached to the composite frame.

Advantageously, embodiments disclosed herein may provide for a more efficient pre-tensioned composite shaker screen design. Embodiments presently disclosed may allow the composite frame to be reused after one or more of the screen assemblies attached to it are worn out. Certain embodiments may also allow a shaker operator to change the screen assembly as is required to adjust the rate of separation of differing drilling fluids from particulate matter.

Also advantageously, embodiments disclosed herein may allow an existing composite frame to be rebuilt with various filtering element configurations for different applications. Thus, entire shaker screens will not need to be discarded; rather, only the removable grid and/or filtering elements will need to be replaced. By decreasing the cost associated with replacing entire shaker screens, the cost of separating drilling fluid from solids may be substantially decreased, thereby decreasing the overall cost of the drilling operation.

While the present disclosure has been described with respect to a limited number of embodiments, those skilled in the art, having benefit of this disclosure, will appreciate that other embodiments can be devised which do not depart from the scope of embodiments disclosed herein. Accordingly, the scope of embodiments disclosed herein should be limited only by the attached claims.

What is claimed:

1. A method comprising:

forming a composite frame with a plurality of cross-members, the cross-members including a plurality of contact points extending upward from a top of the cross-members;

forming a removable grid;

attaching at least one filtering element to the removable grid; and attaching the removable grid to the composite frame, wherein the plurality of contact points of the composite frame support and attach the removable grid.

2. The method of claim 1, further comprising:

pre-tensioning the at least one filtering element to the removable grid.

3. The method of claim 1, wherein the removable grid is formed by injection molding.

4. The method of claim 1, further comprising:

coating the removable grid with at least one of a group consisting of an epoxy and a polymer.

5. The method of claim 1, wherein the attaching the removable grid to the composite frame is one selected from a group consisting of heat staking, ultrasonic welding, and thermal bonding the removable grid to the composite frame.

6. The method of claim 1, wherein the attaching the removable grid to the composite frame comprises mechanically fastening the removable grid to the composite frame.

7. The method of claim 1, wherein the attaching the at least one filtering element to the removable grid comprises stretching the at least one filtering element taut over a plurality of contact points on the removable grid such that the plurality of contact points extend upward through the filtering element.

8. The method of claim 7, wherein the attaching the removable grid to the composite frame further comprises flattening the contact points.

9. The method of claim 1, wherein forming the composite frame is one selected from a group consisting of injection molding, gas-assisted injection molding, and extrusion.

10. A method comprising:

removing a first screen assembly from a composite frame, wherein the first screen assembly includes a removable grid and a first filtering element;

attaching a second filtering element to a second removable grid, wherein the attaching includes stretching the second filtering element taut over a plurality of contact points on the removable grid such that the plurality of contact points extend upward through the filtering element, thereby forming a second screen assembly; and reusing the composite frame, the reusing comprising attaching the second screen assembly to the composite frame.

11. The method of claim 10, wherein the reusing the composite frame comprises bonding the second screen assembly to the composite frame.

12. The method of claim 10, wherein the reusing the composite frame comprises mechanically fastening the second screen assembly to the composite frame.

13. The method of claim 10, wherein the removing the first screen assembly from the composite frame further comprises removing at least one filtering element from the first screen assembly.

14. The method of claim 10, wherein the removing the first screen assembly from the composite frame further comprises removing the removable grid from the composite frame.

15. The method of claim 14, wherein the removing the removable grid from the composite frame comprises mechanically stripping the removable grid from the composite frame.

16. The method of claim 14, wherein the removing the removable grid from the composite frame comprises chemically stripping the removable grid from the composite frame.

* * * * *